US005287643A

United States Patent [19]

Arizpe-Gilmore

[11] Patent Number: 5,287,643

[45] Date of Patent: Feb. 22, 1994

[54] FOLDABLE HUNTING SEAT

[76] Inventor: Roberto Arizpe-Gilmore, Av. San Angel No. 138, Col. Valle De San Angel, Sec. Jardin, San Pedro Garza Garcia, Mexico

[21] Appl. No.: 10,288

[22] Filed: Jan. 28, 1993

[51] Int. Cl.[5] ..... F41A 23/06; F16M 11/38

[52] U.S. Cl. ..... 42/94; 248/125; 297/35

[58] Field of Search ..... 42/94; 297/35, 36, 42, 297/56, 411, 422; 248/125, 164, 166

[56] References Cited

U.S. PATENT DOCUMENTS

| | | | |
|---|---|---|---|
| 1,765,845 | 6/1930 | Melish | 297/36 |
| 2,630,288 | 3/1953 | Eubanks | 297/441 |
| 4,702,029 | 10/1987 | DeVaul et al. | 42/94 |
| 4,886,229 | 12/1989 | Aripze-Gilmore | 248/125 |
| 5,060,410 | 10/1991 | Mueller | 42/94 |
| 5,149,900 | 9/1992 | Buck | 42/94 |
| 5,173,563 | 12/1992 | Gray | 42/94 |

*Primary Examiner*—David H. Brown
*Attorney, Agent, or Firm*—Abelman Frayne & Schwab

[57] ABSTRACT

A scissor type foldable hunting seat, comprising a pair of "U" shaped tubular members, each having a pair of vertical legs jointed by a horizontal fastening edge; both tubular members are coupled through their vertical legs; at least one of the vertical legs having a stop pin near its middle portion; a seat of flexible material grasped to the fastening edges of the tubular members; a weapon support arm having an upper vertical end and a "U" shaped horizontally bent lower end presenting two branches articulately fastened to the vertical legs of the tubular members and a horizontal connecting member which rests in the stop pin of the vertical leg to maintain the weapon support arm in a hunting position and allows to be folded when folding the seat; and a variable height weapon retaining fork coupled to the upper vertical end of the support arm.

2 Claims, 3 Drawing Sheets

FOLDABLE HUNTING SEAT

BACKGROUND OF THE INVENTION

A. Field of the Invention

This invention is related with a foldable scissor type hunting seat to support and/or hold a weapon, and more specifically, to a simplified arrangement to maintain the weapon support arm in a hunting position and allow to be folded when folding the seat.

B. Description of the Previous Art

In the scientific, sport or professional hunting, a fork pole driven in the ground has been used to face its branched end as a support aid for the weapon of the hunter. Such devices have the disadvantage of being more or less foreshortened to avoid annoyance impeding its height adjustment and rotation to stalk and hunt the game being a week support for the weapon and demanding continuous retaining by the hunter.

The hunting tripod is a variation of the fork pole having three legs serving as independent support, this results in an increment in weight and things to carry with.

To make the hunter's operation more comfortable, a series of hunting devices which can be plied, stored and easily carried away has been proposed to avoid the hunter to carry with heavy and annoying equipment.

Applicant's U.S. Pat. No. 4,886,229 discloses a foldable hunting seat comprising a seat and a support arm having variable height weapon retaining means, to support and/or hold the weapon, articulately coupled to said seat, which is adapted to support and/or hold the weapon at an adjustable height without the need of a hunter to grasp it and allows to rotate the weapon.

Said foldable hunting seat includes a foldable fastening linkage for the support arm, comprising a pair of rods articulately coupled to each other and secured to the hunting seat and to the support arm, each having a lock recess and stops to allow a steady retention of said support arm when it is in an assembled position and be folded when folding the hunting seat.

This fastening linkage, however resulted in an increasing production cost of the hunting seat because of the separate manufacture of rods and machining of lock recesses and stops, as well as its incorporation in the hunting seat.

It was therefore highly desirable to provide a simplified arrangement by which said weapon support arm be articulately fastened to the hunting seat to be placed in a hunting position and folded when folding the seat.

To overcome those disadvantages and with the above needs in mind, Applicant has invented a new simplified arrangement to maintain the weapon support arm of the hunting seat in an assembled position and allow to be folded when folding the seat, by including at least a stop pin in at least one of the vertical legs of the hunting seat, and providing the support arm with a "U" shaped lower end presenting two branches articulately fastened to the vertical legs of the tubular members of the seat and a horizontal connecting member which rests in the stop pin of the vertical leg to maintain the weapon support arm in a hunting position and allows to be folded when folding the seat.

SUMMARY OF THE INVENTION

It is therefore a main object of the present invention, to provide a foldable hunting seat adapted to support and/or hold a weapon while the hunter is waiting for the game and to rotate said weapon in said device when stalk and hunt the game.

It is still another main object of the present invention to provide a foldable hunting seat including a simplified arrangement to articulately fasten the weapon support arm to the hunting seat and placed in a hunting position and folded when folding the seat.

It is still another main object of the present invention to provide a foldable hunting seat having a simplified arrangement to articulately fasten the weapon support arm to the hunting seat, without requiring independent manufacture and machining of linkage for said support arm.

It is a further main object of the present invention to provide a foldable hunting seat including at least one stop pin in the middle portion of at least one of the vertical legs, and a support arm having a "U" shaped lower end presenting two branches articulately fastened to the vertical legs of the seat and a horizontal connecting member which rests in the stop pin of the vertical leg to maintain the weapon support arm in a hunting position and allows to be folded when folding the seat.

These and other objects and advantages of the invention will be apparent to those skilled in the art from the description of a preferred embodiment provided in combination with the accompanying drawings.

DETAILED DESCRIPTION OF THE INVENTION

Figure 1:
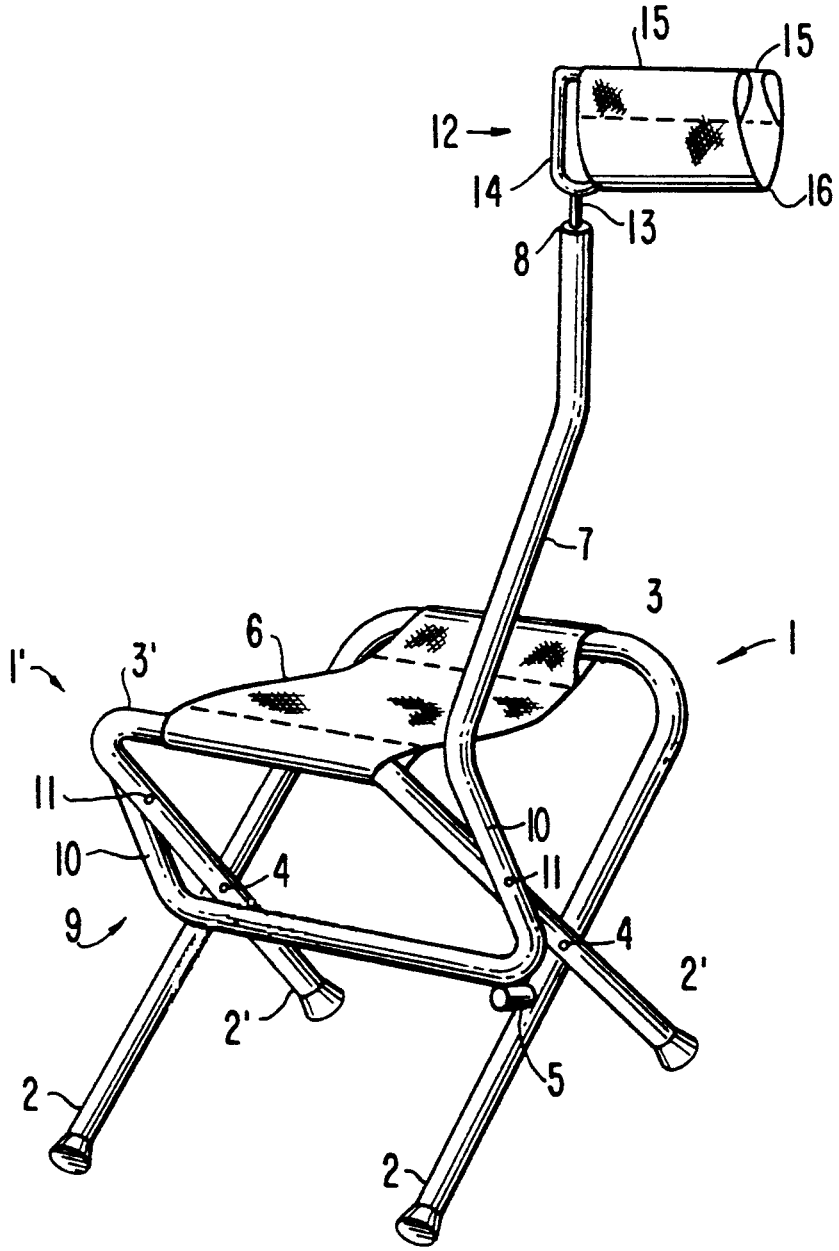
FIG. 1 is a conventional perspective view of the foldable hunting seat of the present invention in a hunting position.
Figure 2:
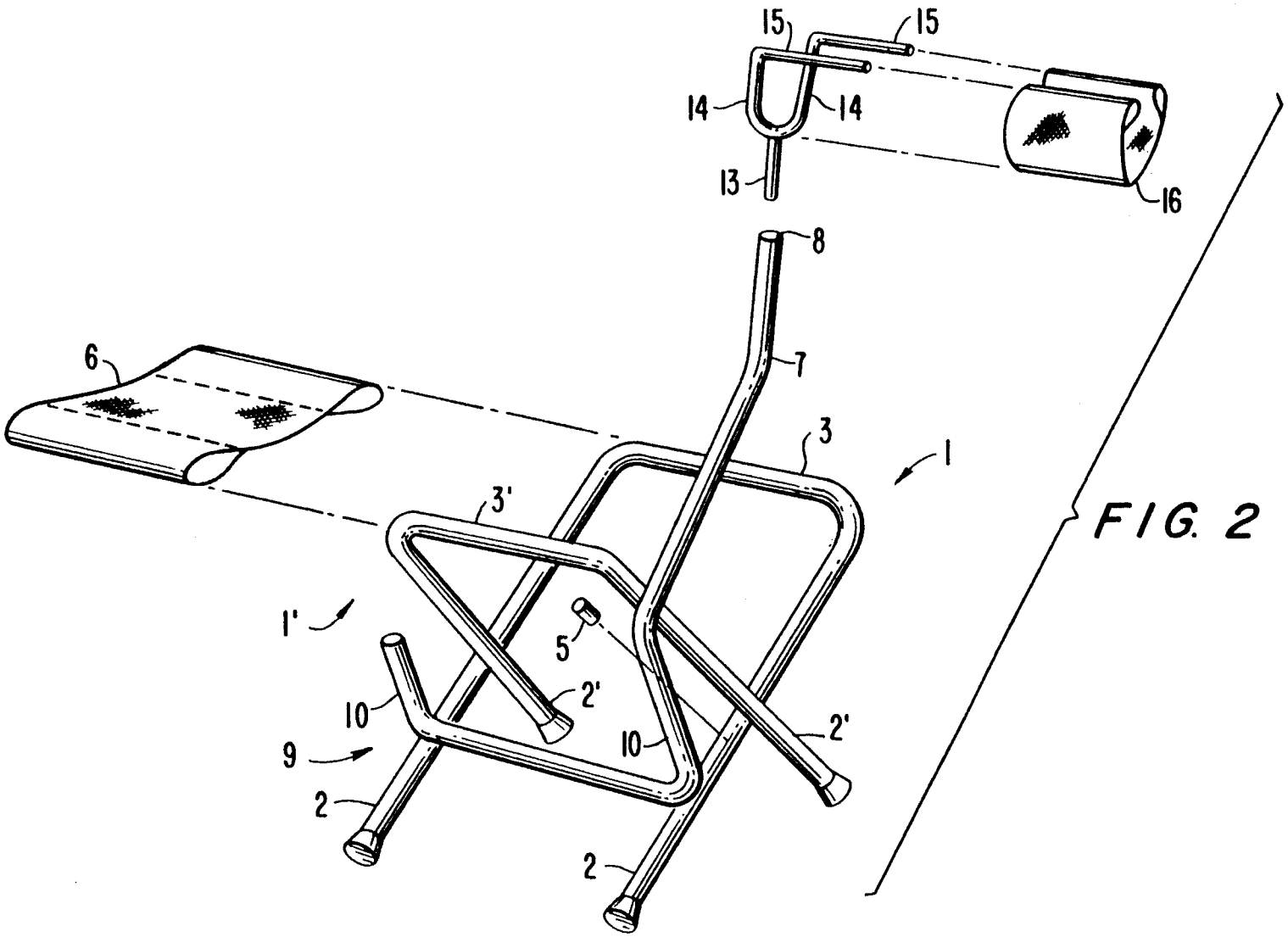
FIG. 2 is a conventional perspective view of the pliable hunting seat of FIG. 1, showing its separated constitutive parts.
Figure 3:
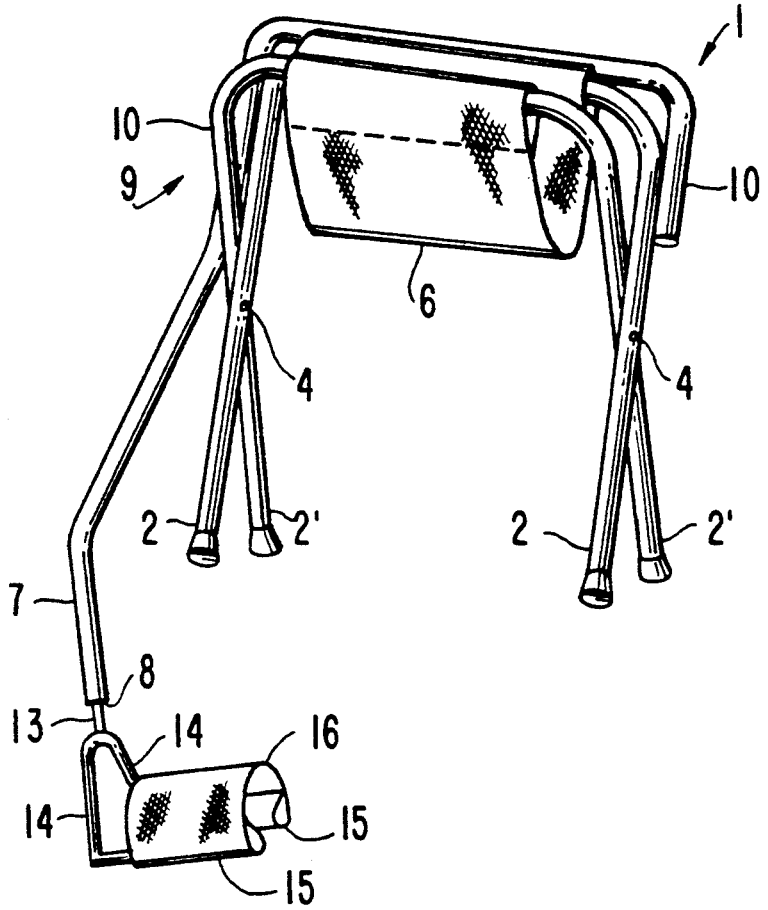
FIG. 3 is an schematic view in which the weapon support device and the hunting seat of FIG. 1, in a folded position.

The invention will now be described with reference to the accompanying drawings, wherein same numerals describe same features of the invention.

The scissor type foldable hunting seat of the present invention, comprising:

a pair of tubular members 1,1', each in the form of an inverted "U" and each having two vertical legs 2,2' jointed by a horizontal fastening edge 3,3'; the fastening edge 3' of the tubular member 1' being of smaller length than the fastening edge 3 of the tubular member I and both tubular members 1,1' are coupled by the middle portions of their vertical legs 2,2' by a pin 4,4;

at least one of the vertical legs 2, having a stop pin 5 coupled near its middle portion;

a seat 6 made of canvas or any other flexible and resistant material grasped to the fastening edges 3,3' of said tubular members 1,1';

a weapon support arm 7 having a threaded upper vertical end 8 and a "U" shaped lower end 9 presenting two branches 10,10 articulately fastened to the vertical legs 2,2' of the tubular members 1,1' by pins 11,11 in such a way that rests in the stop pin 5 of vertical leg 2 and;

a variable height weapon retaining fork 12 having its vertical lower end 13 threaded to the upper end 8 of the support arm 7, and a pair of branched arms 14, 14 each having an horizontal member 15,15 to retain a cot 16 made of a flexible and resistant material, grasped therebetween, so as to retain and/or hold a weapon when the hunter is waiting for the game.

What is claimed is:

1. A scissor type foldable hunting seat, comprising a pair of "U" shaped tubular members, each having a middle portion and a pair of vertical legs jointed by a horizontal upper fastening edge, both tubular members are coupled through the middle portion of their vertical legs; at least one of the vertical legs having stop means coupled near its middle portion; a seat of flexible and resistant material grasped to the fastening edges of the tubular members; and a weapon support arm having a "U" shaped horizontally bent lower end presenting two branches articulately fastened to the vertical legs of the tubular members and a horizontal connecting member which rests in the stop member of the vertical leg, to maintain the weapon support arm in a hunting position and be folded when folding the seat.

2. A foldable hunting seat, as claimed in claim 1, wherein the weapon support arm comprising a threaded upper vertical end and a variable height weapon retaining fork having its vertical lower end screwed in the top of said upper vertical end of the support arm, and a pair of branched arms each having an horizontal member to retain a cot of flexible and resistant material, grasped therebetween, so as to retain and/or hold a weapon as well as to rotate it when stalk and hunt a game.

* * * * *